US009994408B2

(12) United States Patent
Terao

(10) Patent No.: US 9,994,408 B2
(45) Date of Patent: Jun. 12, 2018

(54) SHEET PROCESSING APPARATUS

(71) Applicants: KABUSHIKI KAISHA TOSHIBA, Tokyo (JP); TOSHIBA TEC KABUSHIKI KAISHA, Tokyo (JP)

(72) Inventor: Yasunobu Terao, Izunokuni, Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/094,385

(22) Filed: Apr. 8, 2016

(65) Prior Publication Data

US 2016/0355363 A1 Dec. 8, 2016

(30) Foreign Application Priority Data

Jun. 8, 2015 (JP) ..... 2015-115805

(51) Int. Cl.
*B65H 29/44* (2006.01)
*B65H 29/22* (2006.01)
(Continued)

(52) U.S. Cl.
CPC ..... *B65H 29/44* (2013.01); *B65H 29/22* (2013.01); *B65H 31/02* (2013.01); *B65H 31/3018* (2013.01); *B65H 31/34* (2013.01); *B65H 2301/4212* (2013.01); *B65H 2301/4213* (2013.01); *B65H 2404/1114* (2013.01);
(Continued)

(58) Field of Classification Search
CPC ..... B65H 29/20; B65H 29/22; B65H 29/26; B65H 29/34; B65H 29/38; B65H 29/40; B65H 29/44; B65H 31/24; B65H 31/30; B65H 31/3009; B65H 31/3018; B65H 2301/4226; B65H 2301/42261; B65H 2301/422615; B65H 2404/1114;
(Continued)

(56) References Cited

U.S. PATENT DOCUMENTS 7,043,192 B2 5/2006 Terao et al.
7,159,860 B2 * 1/2007 Sasahara ..... B42C 1/12 270/58.08
7,215,922 B2 5/2007 Terao et al.
7,286,792 B2 * 10/2007 Terao ..... G03G 15/6541 270/58.08
(Continued)

FOREIGN PATENT DOCUMENTS

CN 106185429 12/2016

OTHER PUBLICATIONS

Chinese Office Action dated May 27, 2017, filed in Chinese counterpart Patent Application No. 201610382116.5, 13 pages (with English translation).

*Primary Examiner* — Ernesto A Suarez
(74) *Attorney, Agent, or Firm* — Patterson & Sheridan, LLP

(57) ABSTRACT

According to an embodiment, a sheet processing apparatus includes a first tray, a second tray, and a pressing member. The pressing member includes a turning shaft, the turning shaft being located on the downstream side of a transport direction of the sheet to the first tray, relative to an end of the upstream side of the sheet supported in the first tray, and when the sheet is moved from the first tray toward the second tray, rotates about the turning shaft. The pressing member rotates about the turning shaft, to press the sheet toward the second tray at a position on the upstream side relative to the turning shaft.

15 Claims, 11 Drawing Sheets

(51) Int. Cl.
*B65H 31/02* (2006.01)
*B65H 31/30* (2006.01)
*B65H 31/34* (2006.01)

(52) U.S. Cl.
CPC ..... *B65H 2405/11151* (2013.01); *B65H 2405/332* (2013.01); *B65H 2408/114* (2013.01); *B65H 2701/18262* (2013.01); *B65H 2801/27* (2013.01)

(58) Field of Classification Search
CPC ..... B65H 2405/332; B65H 2405/65; B65H 2408/114; B65H 2801/27
See application file for complete search history.

(56) References Cited

U.S. PATENT DOCUMENTS

| | | | | |
|---|---|---|---|---|
| 7,530,565 | B2 | 5/2009 | Terao et al. | |
| 7,866,647 | B2 | 1/2011 | Terao et al. | |
| 7,976,004 | B2 * | 7/2011 | Kimura | B65H 31/3027 270/58.08 |
| 8,712,316 | B2 * | 4/2014 | Kimura | G03G 15/6541 399/407 |
| 2009/0014941 | A1 | 1/2009 | Taki et al. | |
| 2010/0194020 | A1 * | 8/2010 | Iguchi | B65H 39/10 270/58.07 |
| 2016/0347568 | A1 | 12/2016 | Taki | |
| 2017/0166413 | A1 * | 6/2017 | Taki | B65H 39/10 |

* cited by examiner

SHEET PROCESSING APPARATUS

CROSS-REFERENCE TO RELATED APPLICATION

This application is based upon and claims the benefit of priority from the prior Japanese Patent Application No. 2015-115805, filed on Jun. 8, 2015, the entire contents of which are incorporated herein by reference.

FIELD

An embodiment described here generally relates to a sheet processing apparatus.

BACKGROUND

A post-processing apparatus that performs post-processing on sheets transported from an image-forming apparatus is known. The post-processing apparatus includes a processing tray and a standby tray. In the processing tray, post-processing is performed. The standby tray is provided above the processing tray. During the post-processing performed on sheets in the processing tray, the standby tray temporarily retains subsequent sheets. When the processing tray becomes empty, the standby tray drops the retained sheets toward the processing tray. Further, the post-processing apparatus includes a pressing mechanism that presses the sheets toward the processing tray when the sheets are moved from the standby tray to the processing tray. The pressing mechanism presses the sheets toward the processing tray and thus can quickly move the sheets from the standby tray to the processing tray. Incidentally, the sheets transported by the standby tray may have curls. In the case where the sheets have curls, depending on the configuration of the pressing mechanism, the sheets may be pushed out in an unintentional direction. If the sheets are pushed out in an unintentional direction, the movement of the sheets may be made unstable.

DETAILED DESCRIPTION

Figure 1:
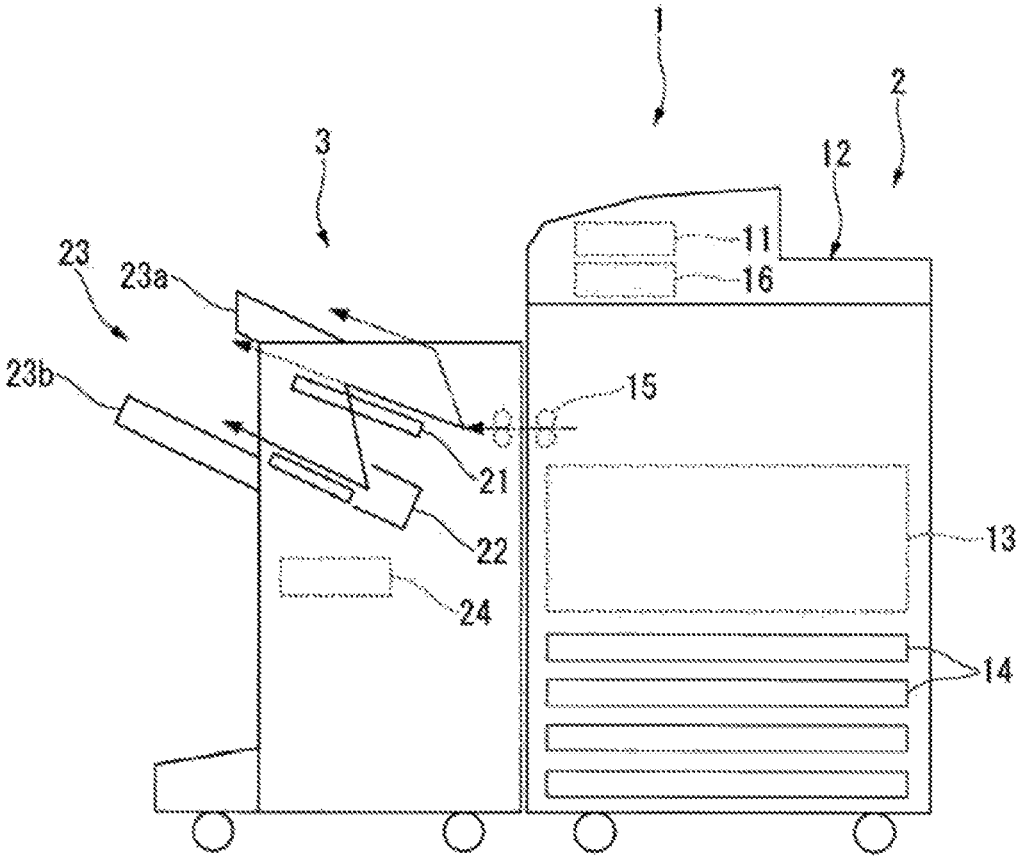
FIG. 1 is a front view showing an example of an overall configuration of an image-forming system according to an embodiment.

According to one embodiment, a sheet processing apparatus includes a first tray, a second tray, and a pressing member. The first tray supports a transported sheet. The second tray is provided below the first tray and houses the sheet moved from the first tray. The pressing member includes a turning shaft, the turning shaft being located on a downstream side of a transport direction of the sheet relative to an end of an upstream side of the sheet supported in the first tray. When the sheet is moved from the first tray toward the second tray, the pressing member rotates about the turning shaft. The pressing member rotates about the turning shaft to press the sheet toward the second tray at a position on the upstream side relative to the turning shaft.

Hereinafter, a sheet processing apparatus of an embodiment will be described with reference to the drawings. It should be noted that in the following description, configurations having an identical or similar function are denoted by an identical reference symbol, and overlapping description thereof may be omitted.

A sheet processing apparatus of an embodiment will be described with reference to FIGS. 1 to 11. First, FIGS. 1 and 2 each show an example of an overall configuration of an image-forming system 1. The image-forming system 1 includes an image-forming apparatus 2 and a post-processing apparatus 3. The image-forming apparatus 2 forms an image on sheet-like media such as paper (hereinafter, described as "sheets"). The post-processing apparatus 3 performs post-processing on the sheets transported from the image-forming apparatus 2. The post-processing apparatus 3 is an example of a "sheet processing apparatus".

The image-forming apparatus 2 includes a control panel 11, a scanner 12, a printer 13, a paper feed unit 14, a paper discharge unit 15, and an image-forming control unit 16.

The control panel 11 includes various keys that receive user's operations. For example, the control panel 11 receives an input on a type of post-processing performed on sheets. The control panel 11 transmits information on the input type of post-processing to the post-processing apparatus 3.

The scanner 12 includes a read section that reads image information of an object to be duplicated. The scanner 12 transmits the read image information to the printer 13. The printer 13 forms an output image (hereinafter, described as "toner image") by a developer such as toner on the basis of the image information transmitted from the scanner 12 or an external device. The printer 13 transfers the toner image onto a surface of a sheet. The printer 13 applies heat and pressure to the toner image transferred onto the sheet, to fix the toner image onto the sheet.

The paper feed unit 14 supplies sheets to the printer 13 one by one at a timing at which the printer 13 forms a toner image. The paper discharge unit 15 transports the sheets, which are discharged from the printer 13, to the post-processing apparatus 3.

The image-forming control unit 16 controls an overall operation of the image-forming apparatus 2. In other words, the image-forming control unit 16 controls the control panel 11, the scanner 12, the printer 13, the paper feed unit 14, and the paper discharge unit 15. The image-forming control unit 16 is a control circuit including a CPU (Central Processing Unit), a ROM (Read Only Memory), and a RAM (Random Access Memory), for example.

Next, the post-processing apparatus (sheet processing apparatus) 3 will be described. First, an overall configuration of the post-processing apparatus 3 will be described. As shown in FIG. 1, the post-processing apparatus 3 is disposed adjacently to the image-forming apparatus 2. The post-processing apparatus 3 executes post-processing on sheets transported from the image-forming apparatus 2, the post-processing being specified through the control panel 11. The post-processing includes stapling processing or sorting processing, for example. The post-processing apparatus 3 includes a standby unit 21, a processing unit 22, a discharge unit 23, and a post-processing control unit 24.

The standby unit 21 temporarily retains (buffers) sheets S (see FIG. 3) transported from the image-forming apparatus 2. For example, the standby unit 21 keeps subsequent sheets S waiting during post-processing performed on preceding sheets S in the processing unit 22. The standby unit 21 is provided above the processing unit 22. When the processing unit 22 becomes empty, the standby unit 21 drops the retained sheets S toward the processing unit 22.

The processing unit 22 performs post-processing on the sheets S. For example, the processing unit 22 aligns the sheets S. The processing unit 22 performs stapling processing on the aligned sheets S. As a result, the sheets S are bound together. The processing unit 22 discharges the sheets S, which are subjected to the post-processing, to the discharge unit 23.

The discharge unit 23 includes a fixed tray 23*a* and a movable tray 23*b*. The fixed tray 23*a* is provided to an upper portion of the post-processing apparatus 3. The movable tray 23*b* is provided to a side portion of the post-processing apparatus 3. The fixed tray 23*a* and the movable tray 23*b* hold the sheets S that are subjected to the sorting processing and then discharged, for example.

The post-processing control unit 24 controls an overall operation of the post-processing apparatus 3. In other words, the post-processing control unit 24 controls the standby unit 21, the processing unit 22, and the discharge unit 23.

Figure 2:
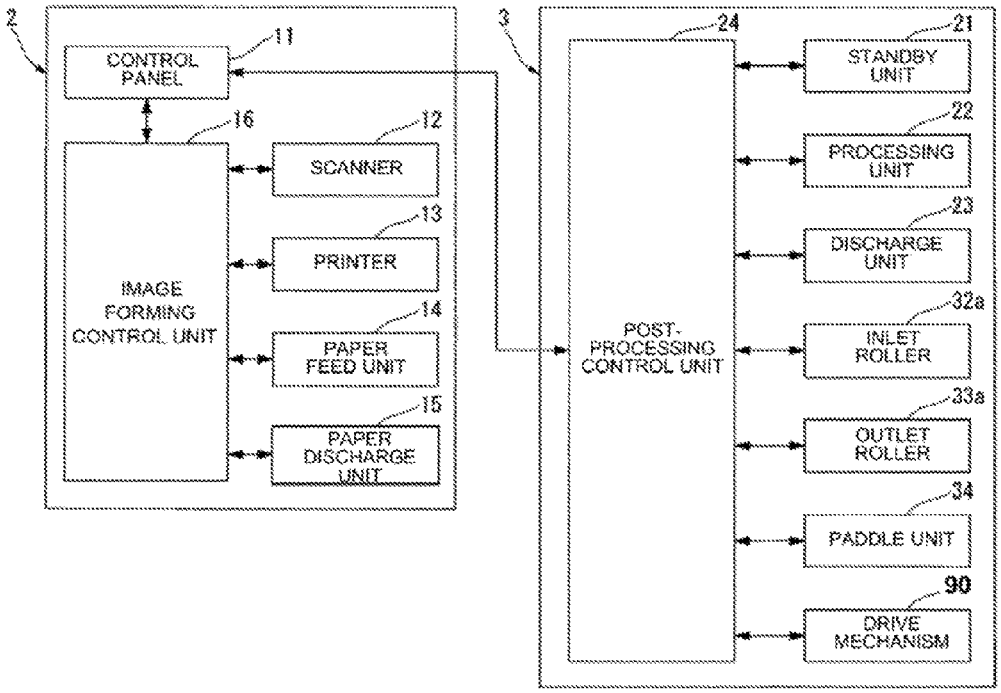
FIG. 2 is a block diagram showing an example of the overall configuration of the image-forming system shown in FIG. 1.

Further, as shown in FIG. 2, the post-processing control unit 24 controls an inlet roller 32*a*, an outlet roller 33*a*, a paddle unit 34, and a drive mechanism 90, which will be described later. The post-processing control unit 24 is a control circuit including a CPU, a ROM, and a RAM, for example.

Next, configurations of the sections of the post-processing apparatus 3 will be described in detail. It should be noted that in description on the following embodiment, a "sheet transport direction" means a transport direction D of the sheets S to a standby tray 41 of the standby unit 21 (entry direction of the sheets S to the standby tray 41). Further, in the description on the following embodiment, an "upstream side" and a "downstream side" mean an upstream side and a downstream side in the sheet transport direction D, respectively. Further, in the description on the following embodiment, a "front end" and a "rear end" mean an "end of the downstream side" and an "end of the upstream side" in the sheet transport direction D, respectively. Additionally, in the description on the following embodiment, a direction that is substantially parallel to an upper surface (transport surface) 45*b* of the standby tray 41 and is substantially orthogonal to the sheet transport direction D is described as a sheet width direction W.

Figure 3:
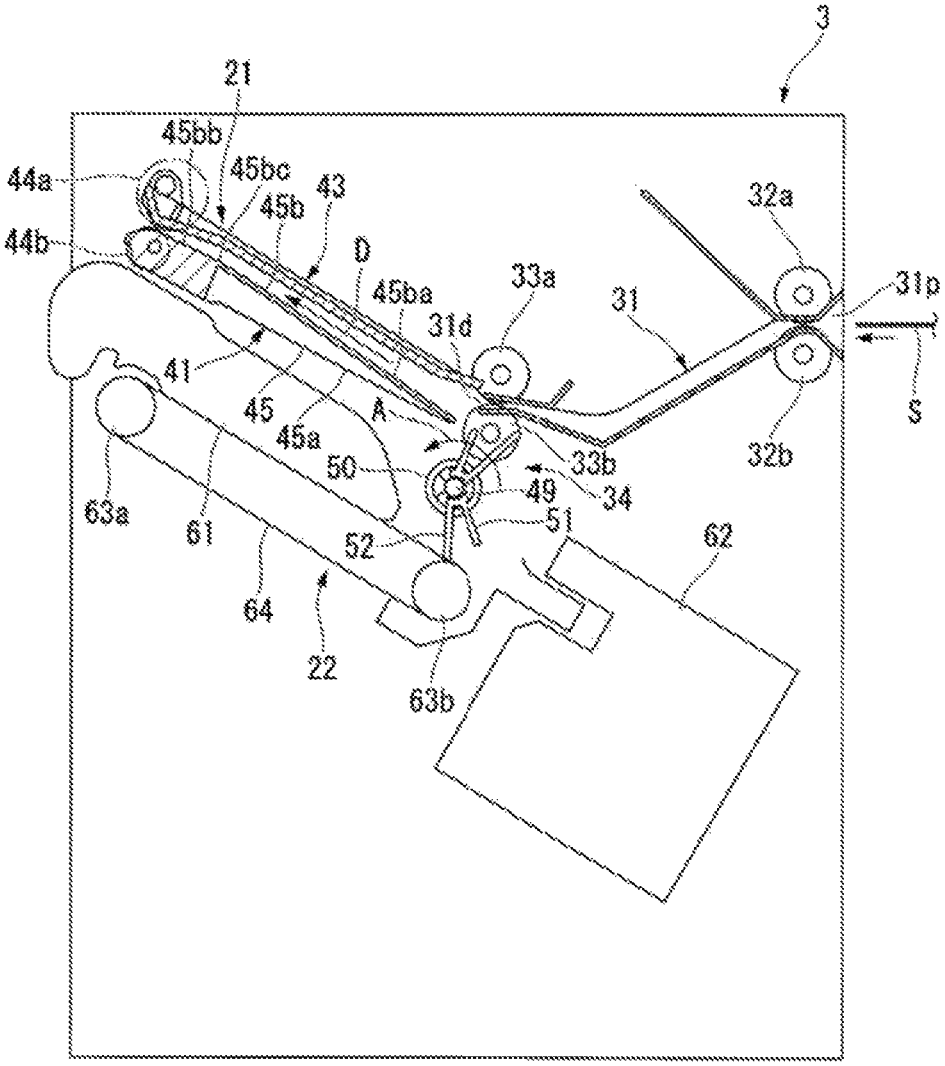
FIG. 3 is a cross-sectional view showing a configuration example of a post-processing apparatus according to the embodiment.

FIG. 3 schematically shows a configuration of the post-processing apparatus 3. As shown in FIG. 3, the post-processing apparatus 3 includes a transport path 31 for the sheets S, a pair of inlet rollers 32*a* and 32*b*, a pair of outlet rollers 33*a* and 33*b*, the standby unit 21, the paddle unit 34, and the processing unit 22.

The transport path 31 is provided inside the post-processing apparatus 3. The transport path 31 includes a sheet supply port 31*p* and a sheet discharge port 31*d*. The sheet supply port 31*p* faces the image-forming apparatus 2. The sheets S are supplied from the image-forming apparatus 2 to the sheet supply port 31*p*. Meanwhile, the sheet discharge port 31*d* is located near the standby unit 21. The sheets S that have passed through the transport path 31 are discharged from the sheet discharge port 31*d* to the standby unit 21.

The inlet rollers 32*a* and 32*b* are provided near the sheet supply port 31*p*. The inlet rollers 32*a* and 32*b* transport the sheets S, which have been supplied to the sheet supply port 31*p*, toward the downstream side of the transport path 31. For example, the inlet rollers 32*a* and 32*b* transport the sheets S, which have been supplied to the sheet supply port 31*p*, to the outlet rollers 33*a* and 33*b*.

The outlet rollers 33*a* and 33*b* are provided near the sheet discharge port 31*d*. The outlet rollers 33*a* and 33*b* receive the sheets S transported by the inlet rollers 32*a* and 32*b*. The outlet rollers 33*a* and 33*b* transport the sheets S from the sheet discharge port 31*d* to the standby unit 21.

Next, the standby unit 21 will be described. The standby unit 21 includes the standby tray (buffer tray) 41, an opening and closing drive unit 42 (see FIG. 4), a transport guide 43, and discharge rollers 44*a* and 44*b*.

The standby tray 41 is an example of a "first tray". The rear end of the standby tray 41 is located near the outlet rollers 33*a* and 33*b*. The rear end of the standby tray 41 is located to be slightly lower than the sheet discharge port 31*d* of the transport path 31. The standby tray 41 is tilted with respect to a horizontal direction so as to gradually increase in height toward the downstream side of the sheet transport direction D. During post-processing performed on preceding sheets in the processing unit 22, the standby tray 41 holds subsequent sheets S in an overlapping manner in order to keep the subsequent sheets S waiting.

The standby tray 41 includes a bottom wall 45 and side walls (not shown). The bottom wall 45 includes a lower surface 45*a* and the upper surface (transport surface) 45*b*. The bottom wall 45 supports the sheets S from below. The side walls support side portions of the sheets S in the sheet width direction W.

The bottom wall 45 will be specifically described. For example, the lower surface 45*a* of the bottom wall 45 is formed in a substantially flat surface. Meanwhile, the upper surface 45*b* of the bottom wall 45 includes a first area 45*ba* and a second area 45*bb*. The first area 45*ba* is provided adjacently to the rear end of the standby tray 41. The first area 45*ba* is tilted with respect to the lower surface 45*a* so as to gradually increase a distance from the lower surface 45*a* toward the downstream side of the sheet transport direction D. Meanwhile, the second area 45*bb* is provided between a front end of the standby tray 41 and the first area 45*ba*. The second area 45*bb* has a fixed distance from the lower surface 45*a* or a reduced distance from the lower surface 45*a* even toward the downstream side of the sheet transport direction D. The upper surface 45*b* includes a boundary portion 45*bc* between the first area 45*ba* and the second area 45*bb*. The bottom wall 45 has the maximum thickness in the boundary portion 45*bc*.

Figure 4:
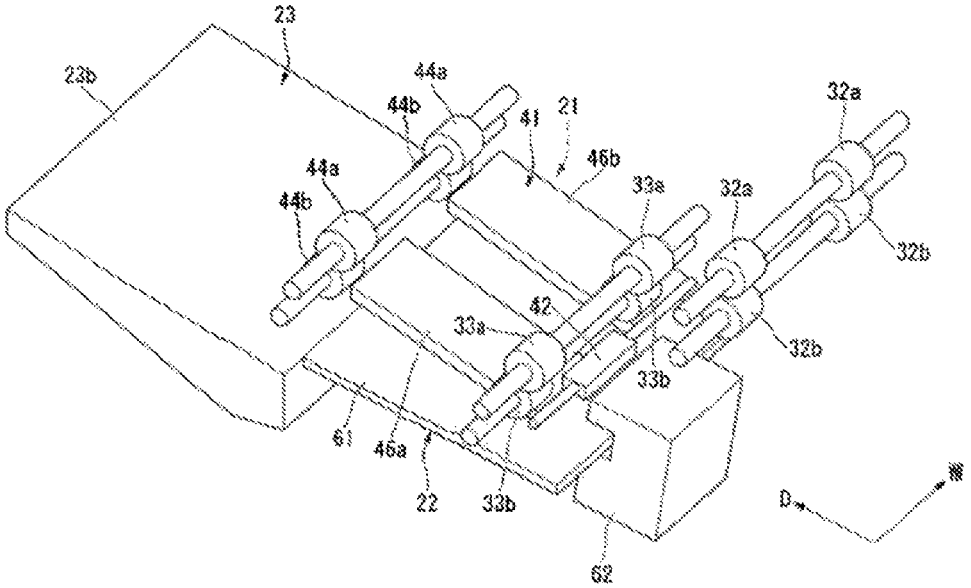
FIG. 4 is a perspective view showing a standby unit and a processing unit shown in FIG. 3.

FIG. 4 schematically shows the standby tray 41. As shown in FIG. 4, the standby tray 41 includes a first tray member 46*a* and a second tray member 46*b*. The first tray member 46*a* and the second tray member 46*b* are separated from each other in the sheet width direction W. The first tray member 46*a* and the second tray member 46*b* are movable in a mutually approaching direction and a mutually separating direction.

The opening and closing drive unit 42 can drive the first tray member 46*a* and the second tray member 46*b* in the mutually approaching direction and the mutually separating direction. In the case where the sheets S wait in the standby tray 41, the opening and closing drive unit 42 drives the first tray member 46*a* and the second tray member 46*b* so as to approach each other. As a result, the sheets S are supported by the first tray member 46*a* and the second tray member 46*b*. Meanwhile, in the case where the sheets S are moved from the standby tray 41 toward a processing tray 61 of the processing unit 22, the opening and closing drive unit 42 drives the first tray member 46*a* and the second tray member 46*b* so as to separate from each other. As a result, the sheets S supported by the standby tray 41 drop toward the processing tray 61 from a gap between the first tray member 46*a* and the second tray member 46*b*. As a result, the sheets S are moved from the standby tray 41 to the processing tray 61.

The transport guide 43 (assist guide) is an example of a "first member (first pressing member, first biasing member)". As shown in FIG. 3, the transport guide 43 is provided above the standby tray 41. For example, the transport guide 43 has a length substantially equal to or larger than the half length of the standby tray 41 in the sheet transport direction D. In this embodiment, the transport guide 43 has substantially the same length as the standby tray 41 in the sheet transport direction D. The transport guide 43 is a plate-like member extending over the standby tray 41 (see FIG. 6). The sheets S discharged from the outlet rollers 33*a* and 33*b* enter a gap between the transport guide 43 and the standby tray 41. The sheets S that have entered the standby unit 21 are guided by the transport guide 43 and the standby tray 41 and proceed toward the depth of the standby unit 21. It should be noted that the transport guide 43 will be described later in detail.

As shown in FIG. 3, the discharge rollers 44*a* and 44*b* are provided near the front end of the standby tray 41. In the case where the sheets S are directly discharged from the standby tray 41 to the discharge unit 23, the discharge rollers 44*a* and 44*b* transport the sheets S toward the movable tray 23*b* of the discharge unit 23.

Next, the paddle unit 34 will be described. As shown in FIG. 3, the paddle unit 34 is provided between the standby tray 41 and the processing tray 61. In other words, the paddle unit 34 is provided below the standby tray 41. In the case where the sheets S are moved from the standby tray 41 toward the processing tray 61, the paddle unit 34 rotates and thus presses the sheets S toward the processing tray 61. Additionally, the paddle unit 34 moves the sheets S, which have dropped on the processing tray 61, toward a stapler 62 that will be described later. Specifically, the paddle unit 34 includes a rotating shaft 49, a rotating body 50, first paddles 51, and second paddles 52.

The rotating shaft 49 is the center of rotation of the rotating body 50 of the paddle unit 34. The rotating shaft 49 is located below the standby tray 41. The rotating shaft 49 extends in the sheet width direction W. The paddle unit 34 is rotated about the rotating shaft 49 in a direction of an arrow A in FIG. 3. The rotating body 50 is cylindrically formed. The rotating body 50 is rotated about the rotating shaft 49. The rotating body 50 is provided with the first paddles 51 and the second paddles 52.

The first paddles 51 and the second paddles 52 protrude from the rotating body 50 in a radial direction of the rotating body 50. The first paddles 51 and the second paddles 52 are each formed of an elastic member such as rubber. For example, the first paddles 51 are rotated at a timing at which the sheets S are moved from the standby tray 41 toward the processing tray 61, to press the sheets S toward the processing tray 61. As a result, also in the case where the sheets S stick to the transport guide 43, the sheets S are reliably removed from the transport guide 43.

The second paddles 52 are located behind the respective first paddles 51 in the rotation direction of the rotating body 50 of the paddle unit 34. The length of each second paddle 52 is larger than that of each first paddle 51 in the radial direction of the rotating body 50. The second paddles 52 are rotated to come into contact with the upper surface of a sheet S, which is located in the uppermost position in the sheets S that have dropped on the processing tray 61. The second paddles 52 are further rotated in the state of being in contact with the upper surface of the sheet S, and thus moves the sheets S toward the stapler 62. It should be noted that a detailed operation of the paddle unit 34 will be described later.

Next, the processing unit 22 will be described. The processing unit 22 includes the processing tray 61, the stapler 62, transport rollers 63*a* and 63*b*, and a transport belt 64.

The processing tray 61 is an example of a "second tray". The processing tray 61 is provided below the standby tray 41. The processing tray 61 is tilted with respect to the horizontal direction so as to gradually increase in height toward the downstream side of the sheet transport direction D. For example, the processing tray 61 is tilted substantially parallel to the standby tray 41. The processing tray 61 aligns the sheets S, which have been moved from the standby tray 41, in the sheet width direction W and the sheet transport direction D by an alignment plate or the like.

The stapler 62 is provided to an end of the processing tray 61. The stapler 62 performs stapling (binding) processing on a batch of a predetermined number of sheets S located on the processing tray 61.

The transport rollers 63*a* and 63*b* are disposed with a predetermined interval therebetween in the sheet transport direction D. The transport belt 64 is stretched over the transport rollers 63*a* and 63*b*. The transport belt 64 is rotated in synchronization with the transport rollers 63*a* and 63*b*. The transport belt 64 transports the sheets S between the stapler 62 and the discharge unit 23.

Figure 5:
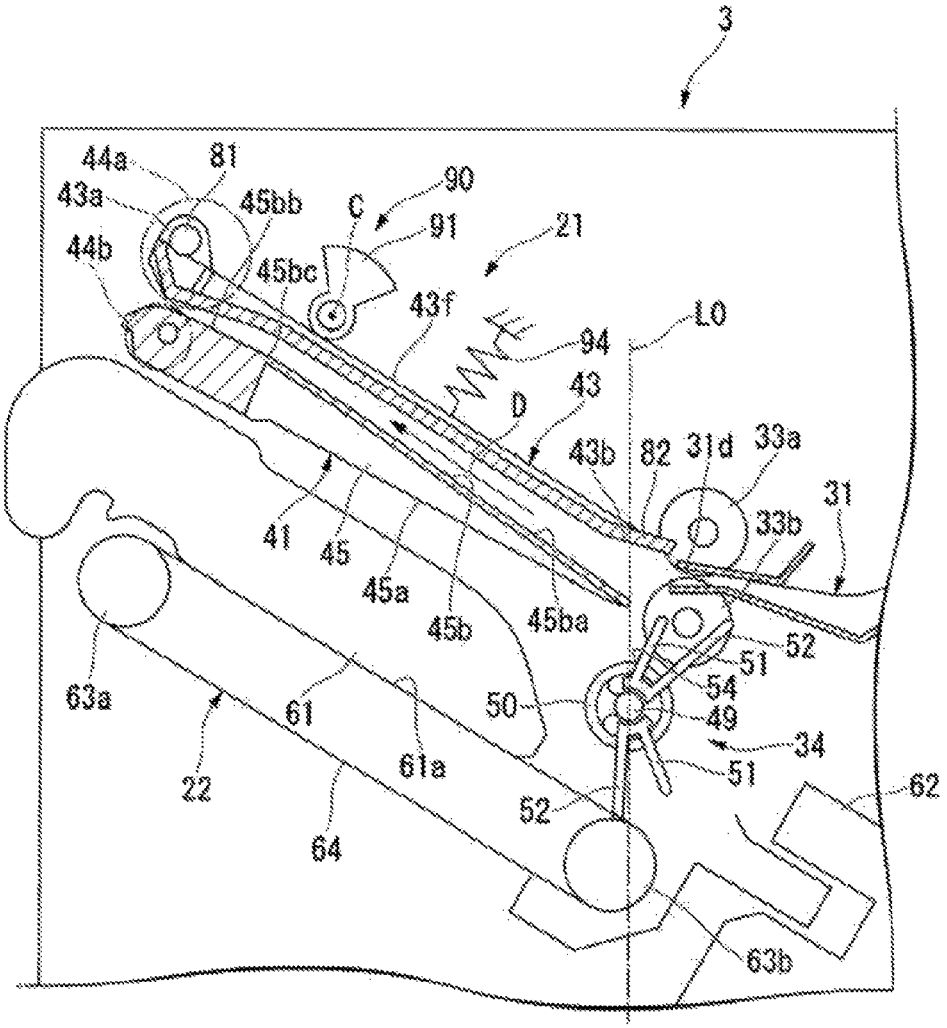
FIG. 5 is a cross-sectional view showing the standby unit and the processing unit shown in FIG. 3.

Next, the transport guide 43 and the paddle unit 34 will be described in detail. FIG. 5 shows the transport guide 43 in an enlarged manner. The transport guide 43 of this embodiment has a function of pressing (biasing) the sheets S toward the processing tray 61 in the case where the sheets S are moved from the standby tray 41 toward the processing tray 61. Specifically, the transport guide 43 is movable between a standby position (see FIG. 8) and a protruding position (see FIG. 9). The standby position is an example of a "first position". In the standby position, the whole of the transport guide 43 is located above the standby tray 41 and faces the standby tray 41. Additionally, in the standby position, the transport guide 43 guides the transported sheets S to the standby tray 41. In other words, the standby position is a guide position at which the transport guide 43 guides the sheets S. The protruding position is an example of a "second position". In the protruding position, at least a part of the transport guide 43 protrudes downward below the lower surface 45*a* of the standby tray 41. In the case where the sheets S are moved from the standby tray 41 toward the processing tray 61, the transport guide 43 can press the sheets S toward the processing tray 61 by moving from the standby position to the protruding position.

Specifically, as shown in FIG. 5, the transport guide 43 includes a first end 43*a* and a second end 43*b* in the sheet transport direction D. The first end 43*a* is an end of the downstream side in the sheet transport direction D. The second end 43*b* is an end of the upstream side in the sheet transport direction D.

The first end 43*a* includes a turning shaft 81. The turning shaft 81 is a pivot point of turn (center of turn) of the transport guide 43. The turning shaft 81 of this embodiment is provided at substantially the same position as the front end of the standby tray 41 in the sheet transport direction D. Thus, the turning shaft 81 is located on the downstream side of the sheet transport direction D relative to a rear end Sa (see FIG. 8) of the sheets S housed in the standby tray 41. In this embodiment, the turning shaft 81 is disposed near the discharge roller 44*a* located above the standby tray 41. Further, from a different perspective, the turning shaft 81 is located on the downstream side of the sheet transport direction D relative to the boundary portion 45*bc* (portion having the maximum thickness) of the upper surface 45*b* of the standby tray 41. Additionally, from a different perspective, the turning shaft 81 is located on the downstream side of the sheet transport direction D relative to a drive member 91 that will be described later.

The second end 43*b* includes a pressing portion 82 that comes into contact with the sheets S. In this embodiment, the pressing portion 82 is located on the upstream side of the sheet transport direction D relative to the turning shaft 81. In the case where the sheets S are moved from the standby tray 41 toward the processing tray 61, the transport guide 43 is rotated about the turning shaft 81, so that the pressing portion 82 presses the sheets S toward the processing tray 61 at the position on the upstream side relative to the turning shaft 81.

As shown in FIG. 5, the pressing portion 82 is located near the sheet discharge port 31*d* of the transport path 31. For example, the pressing portion 82 overlaps with at least a part of the rotating shaft 49 of the paddle unit 34 in a vertical direction (see a virtual line L0 in FIG. 5). In this embodiment, the pressing portion 82 extends to a position close to the sheet discharge port 31*d* beyond the virtual line L0 passing through the rotating shaft 49 of the paddle unit in the vertical direction. In this embodiment, the pressing portion 82 is located above the rear end Sa of the sheets S housed in the standby tray 41 (see FIG. 8). The pressing portion 82 presses the rear end Sa of the sheets S toward the processing tray 61. The pressing portion 82 presses the rear end Sa of the sheets S at a position that is as close to a rear edge Se of the sheets S as possible. For example, the pressing portion 82 presses an area located at a distance of less than 20 mm from the rear edge Se of the sheets S.

Figure 9:
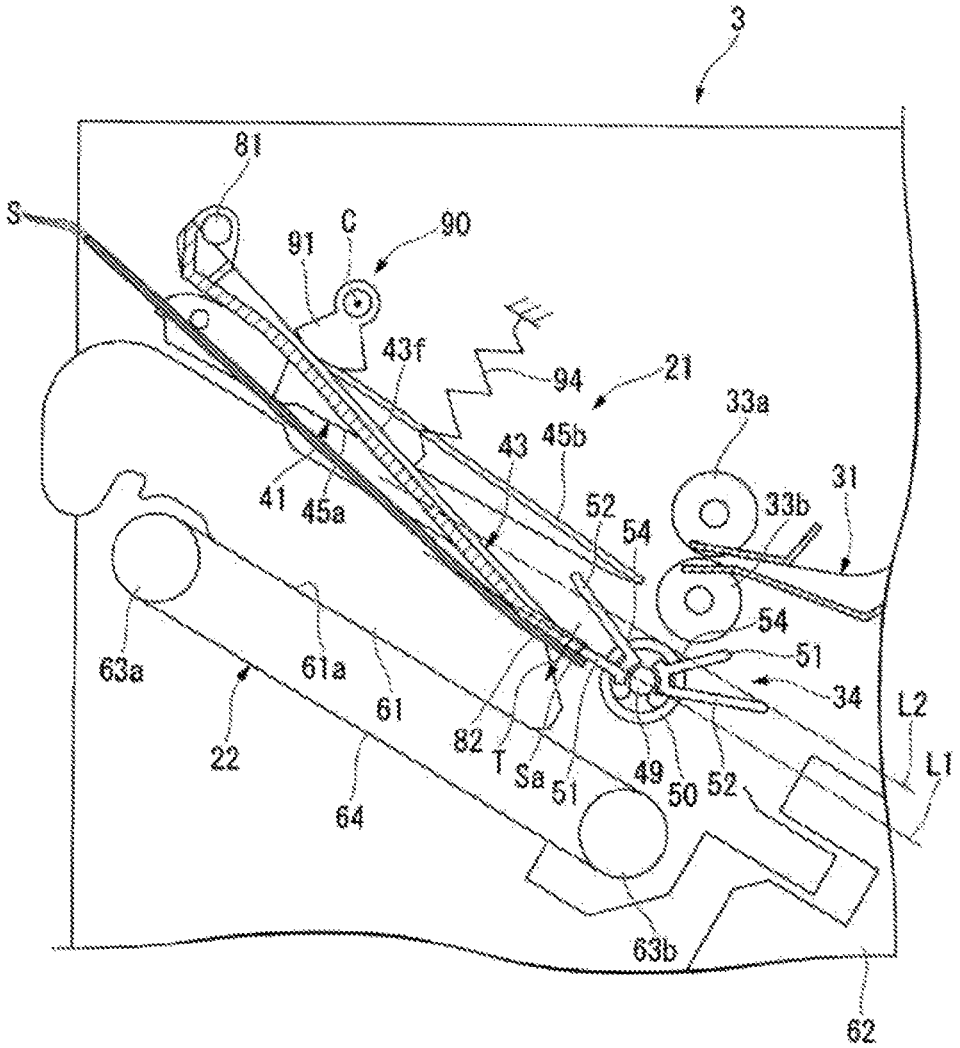
FIG. 9 is a cross-sectional view showing an operation of the post-processing apparatus according to the embodiment.

For example, the pressing portion 82 descends to a position aligned with at least a part of the rotating shaft of the paddle unit 34 in a direction substantially parallel to an upper surface 61*a* of the processing tray 61 (see a virtual line L1 in FIG. 9). In other words, the pressing portion 82 presses the rear end Sa of the sheets S to a position aligned with at least a part of the rotating shaft 49 of the paddle unit 34 in the direction substantially parallel to the upper surface 61*a* of the processing tray 61. It should be noted that the upper surface 61*a* of the processing tray 61 is an example of a "sheet placing surface" on which the sheets S are placed.

Further, from a different perspective, the pressing portion 82 descends to a position lower than a base 54 of at least one of the paddles 51 and 52 in the direction substantially parallel to the upper surface 61*a* of the processing tray 61. It should be noted that the base 54 of each of the paddles 51 and 52 is a boundary portion between each of the paddles 51 and 52 and the rotating body 50. In other words, the pressing portion 82 descends to a position lower than an upper end of the rotating body 50 (see a virtual line L2 in FIG. 9) in the direction substantially parallel to the upper surface 61*a* of the processing tray 61.

Figure 6:
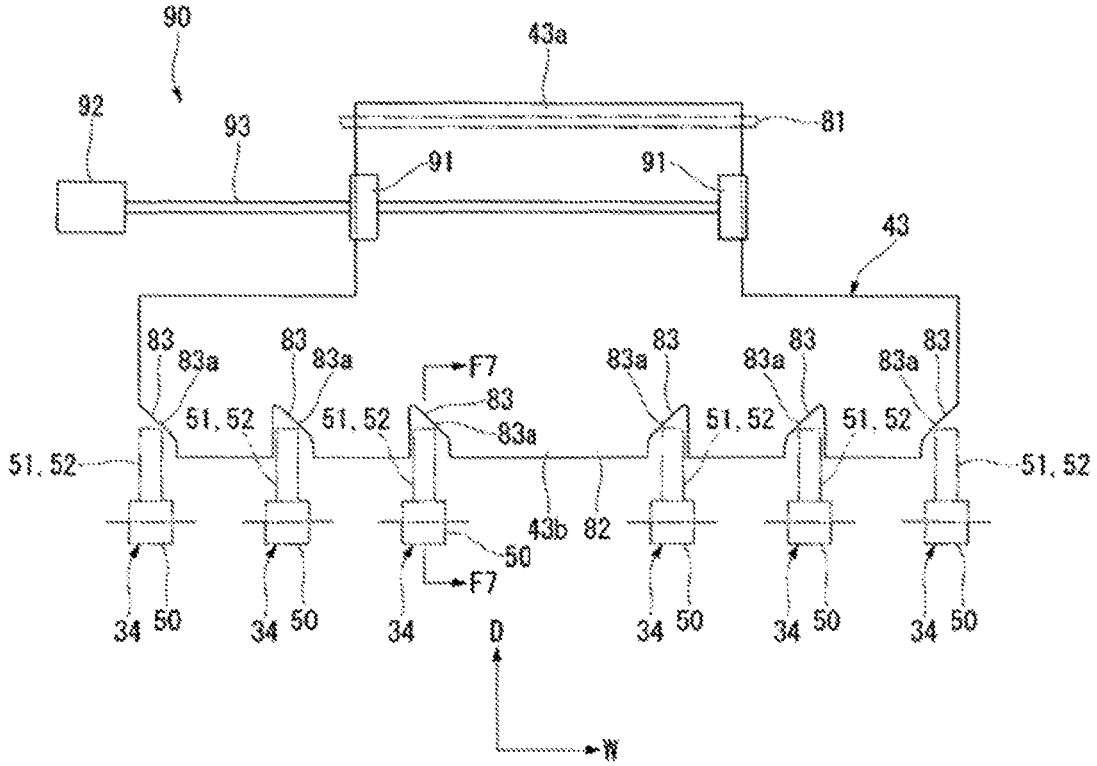
FIG. 6 is a plan view showing a transport guide shown in FIG. 5.

FIG. 6 is a top view of the transport guide 43. The width of the second end 43*b* in the sheet width direction W is larger than the width of the first end 43*a* in the sheet width direction W. For example, the second end 43*b* has a width that is sufficient to cover the rear end of the sheets S having various standards (for example, postcard size, B5 size, and A4 size).

Here, as shown in FIG. 6, the paddle unit 34 includes the first paddles 51 and the second paddles 52. The first paddles 51 are provided to be separated from one another in the sheet width direction W. Similarly, the second paddles 52 are provided to be separated from one another in the sheet width direction W. For example, the first and second paddles 51 and 52 are disposed separately at positions corresponding to both ends of the sheets S having the various standards in the sheet width direction W.

As shown in FIG. 6, the second end 43*b* is provided with notches 83. The notches 83 are provided separately from one another in the sheet width direction W. The notches 83 are provided at positions corresponding to the first and second paddles 51 and 52. Each notch 83 extends from a rear edge of the second end 43*b* in the sheet transport direction D. The first and second paddles 51 and 52 pass through the notches 83 respectively corresponding thereto, and thus can rotate without interfering with the transport guide 43. In other words, the transport guide 43 and the first and second paddles 51 and 52 have a pectinate shape.

As shown in FIG. 6, the transport guide 43 of this embodiment extends to the upstream side of the sheet transport direction D beyond at least a part of the rotation trajectories (rotation pathways) of the first paddles 51 and the second paddles 52. Thus, the transport guide 43 of this embodiment can press the rear edge Se of the sheets S or a portion close to the rear edge Se of the sheets S toward the processing tray 61.

The first paddles 51 of this embodiment pass through the notches 83, and thus can press the sheets S being pressed by the transport guide 43. In other words, the first paddles 51 can press the rear end Sa of the sheets S more downward in the state where the transport guide 43 is pressing the rear end Sa of the sheets S downward.

Next, the shape of the notch 83 will be described in detail. As shown in FIG. 6, each notch 83 includes a first tilted surface 83*a* that is tilted with respect to the sheet transport direction D. With the first tilted surface 83*a*, the width of the notch 83 in the sheet width direction W is gradually reduced toward the downstream side of the sheet transport direction D. When the first tilted surface 83*a* is provided, the sheets S that have entered the notch 83 are guided by the first tilted surface 83*a*, and thus are easy to come out of the notch 83.

Figure 7:
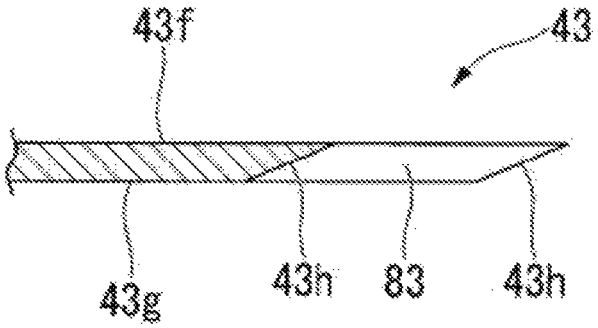
FIG. 7 is a cross-sectional view of the transport guide taken along the line F7-F7 shown in FIG. 6.

FIG. 7 is a cross-sectional view of the transport guide 43 taken along the line F7-F7 shown in FIG. 6. As shown in FIG. 7, the transport guide 43 includes an upper surface 43*f*, a lower surface 43*g*, and a second tilted surface 43*h*. The second tilted surface 43*h* is provided to the rear end of the transport guide 43. The second tilted surface 43*h* is provided between the upper surface 43*f* and the lower surface 43*g*. The second tilted surface 43*h* is tilted so as to approach the lower surface 43*g* toward the downstream side of the sheet transport direction D. The second tilted surface 43*h* is provided to both the notches 83 and portions excluding the notches 83, in the transport guide 43. When the second tilted surface 43*h* as described above is provided, the sheets S being in contact with the transport guide 43 are guided by the second tilted surface 43*h* and thus are easy to orient to a gap between the transport guide 43 and the standby tray 41.

Next, the drive mechanism 90 that drives the transport guide 43 will be described. As shown in FIG. 5, the drive mechanism 90 includes the drive member 91, a drive source 92 (see FIG. 6), a driving force transmission mechanism 93 (see FIG. 6), and a spring 94.

The drive member 91 is a member to move the transport guide 43 from the standby position to the protruding position. As shown in FIG. 5, for example, the drive member 91 is a cam. The drive member 91 has the center of rotation C located above the standby tray 41. The drive member 91 is a cam having an outer circumferential surface that is eccentric relative to the center of rotation C. The drive member 91 comes into contact with the upper surface 43*f* of the transport guide 43 by being rotated about the center of rotation C. The drive member 91 presses the transport guide 43 downward by being further rotated in a state of being in contact with the upper surface 43*f* of the transport guide 43. As a result, the drive member 91 moves the transport guide 43 from the standby position toward the protruding position. As shown in FIG. 6, the drive member 91 is connected to the drive source 92 via the driving force transmission mechanism 93. The drive source 92 is a motor, for example. The drive source 92 rotates the drive member 91 via the driving force transmission mechanism 93.

As shown in FIG. 5, the spring 94 is provided on the upper side of the transport guide 43. The spring 94 biases the transport guide 43 upward. Thus, the transport guide 43 that has moved to the protruding position returns to the standby position by the biasing force of the spring 94, when depression by the drive member 91 is released.

Figure 8:
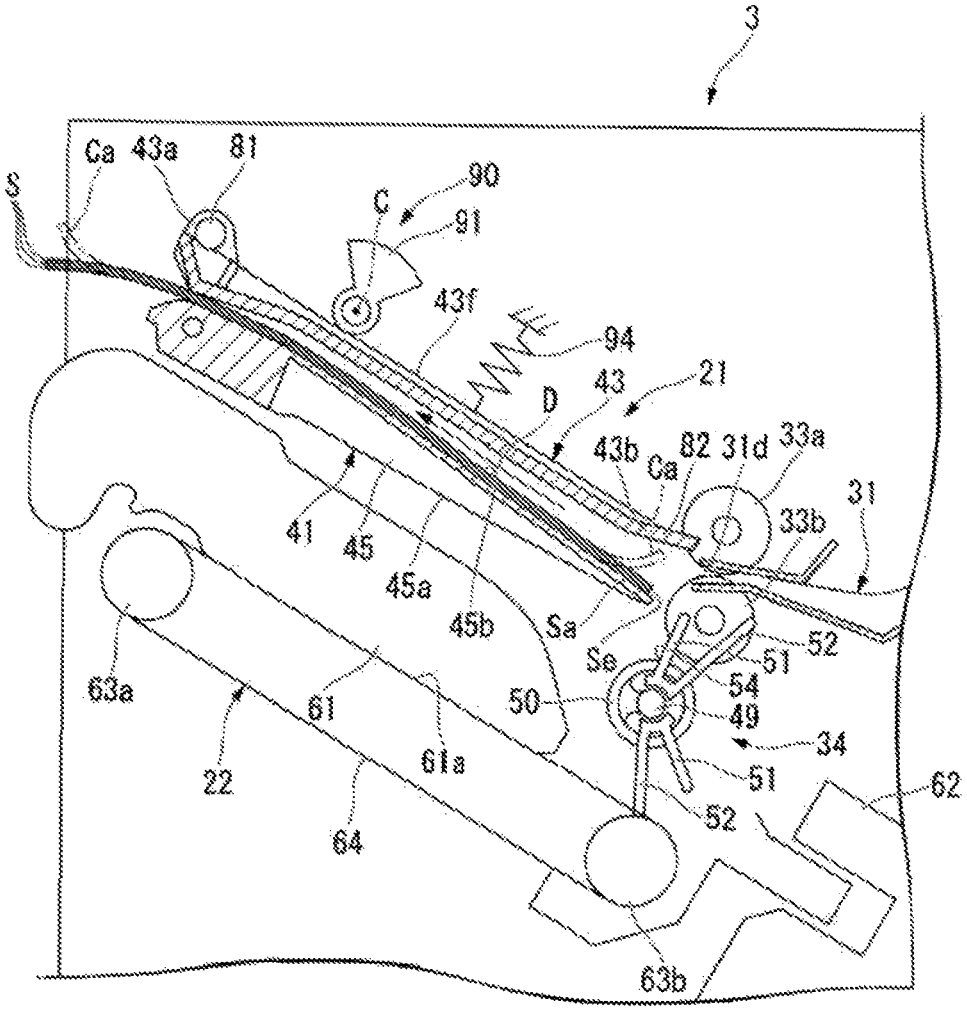
FIG. 8 is a cross-sectional view showing an operation of the post-processing apparatus according to the embodiment.

Next, an operation flow in which the sheets S are dropped from the standby tray 41 toward the processing tray 61 will be described. FIG. 8 shows a state where the sheets S enter the standby tray 41. In the case where the sheets S enter the standby tray 41, the transport guide 43 is located above the standby tray 41. The sheets S are transported to the depth of the standby tray 41 by being guided by the standby tray 41 and the transport guide 43.

FIG. 9 shows a state where the sheets S are moved from the standby tray 41 toward the processing tray 61. In the case where the sheets S are moved from the standby tray 41 toward the processing tray 61, the post-processing control unit 24 controls the drive of the drive source 92 to rotate the drive member 91. When the drive member 91 rotates, the transport guide 43 is pressed downward.

The transport guide 43 pressed downward rotates about the turning shaft 81, and thus presses the rear end Sa of the sheets S toward the processing tray 61. The transport guide of this embodiment presses the sheets S toward the processing tray 61 at a position on the upstream side of the sheet transport direction D relative to the turning shaft 81.

Additionally, the post-processing control unit 24 rotates the paddle unit 34 in a state where the transport guide 43 is pressing the sheets S. In other words, the post-processing control unit 24 rotates the paddle unit 34 in a state where at least a part of the transport guide 43 protrudes downward below the standby tray 41. For example, the paddle unit 34 is rotated such that the first paddles 51 pass through the notches 83 in a state where the transport guide 43 is moved to the lowermost position. As a result, the first paddles 51 press the rear end Sa of the sheets S being pressed by the transport guide 43.

When the paddle unit 34 is rotated in a state where the transport guide 43 is pressing the sheets S, a contact direction T of the first paddles 51 with respect to the sheets S is unlikely to be oriented in the opposite direction to the stapler 62. For example, the first paddles 51 press the sheets S in a state where the transport guide 43 descends to a position aligned with the rotating shaft 49 of the paddle unit 34 in a direction substantially parallel to the upper surface 61*a* of the processing tray 61. When the first paddles 51 press the sheets S in such a manner, the contact direction T of the first paddles 51 with respect to the sheets S is substantially orthogonal to the upper surface 61*a* of the processing tray 61. Thus, it is possible to prevent the sheets S from being pressed by the paddle unit 34 toward the opposite direction to the stapler 62.

Figure 10:
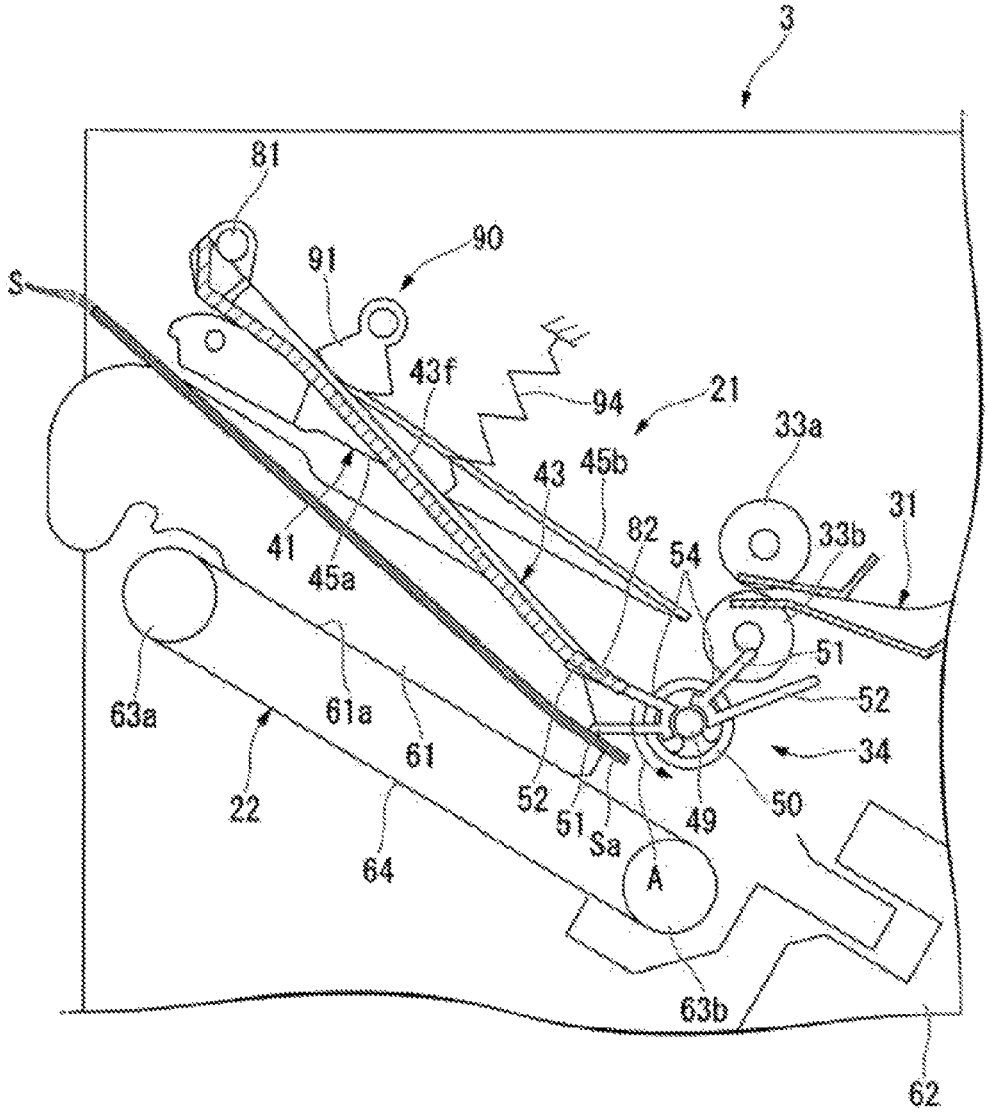
FIG. 10 is a cross-sectional view showing an operation of the post-processing apparatus according to the embodiment.

FIG. 10 shows a state immediately after the first paddles 51 press the sheets S. As shown in FIG. 10, the first paddles 51 come into contact with the falling sheets S while rotating about the rotating shaft 49. As a result, the first paddles 51 causes a force oriented to the stapler 62 to act on the falling sheets S.

Figure 11:
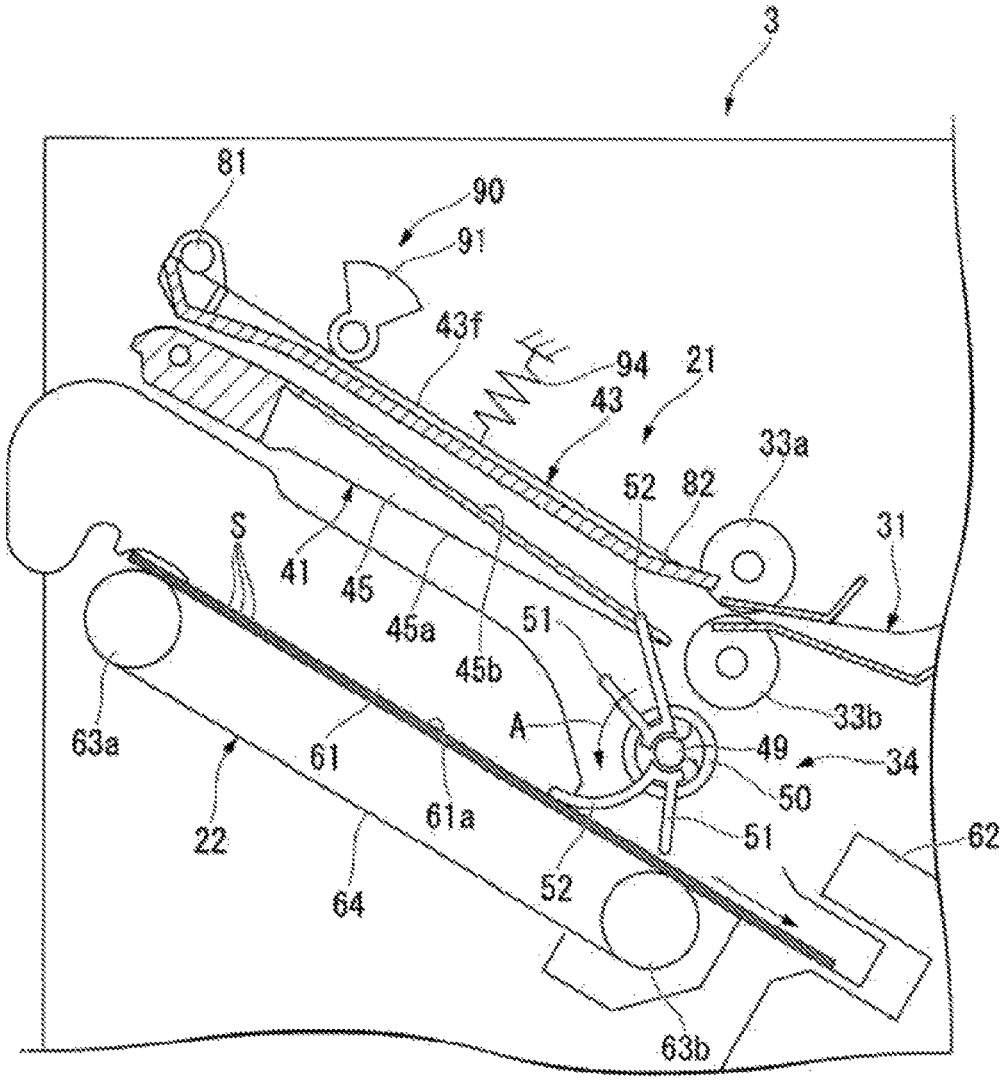
FIG. 11 is a cross-sectional view showing an operation of the post-processing apparatus according to the embodiment.

FIG. 11 shows a state where the sheets S on the processing tray 61 are transported toward the stapler 62. As shown in FIG. 11, the second paddles 52 of the paddle unit 34 are rotated with respect to the sheets S that have dropped on the processing tray 61. As a result, the sheets S on the processing tray 61 are transported toward the stapler 62 by the second paddles 52. Further, in this case, the transport rollers 63*a* and 63*b* and the transport belt 64 of the processing tray 61 are driven to transport the sheets S toward the stapler 62. As a result, the sheets S on the processing tray 61 are transported toward the stapler 62.

According to the post-processing apparatus 3 having the configuration as described above, the stability of movement of the sheets S can be improved.

Here, for the purpose of comparison, a pressing mechanism will be conceived, in which a pressing portion that presses the sheets S is located on the downstream side of the sheet transport direction D with respect to the turning shaft. In such a configuration, the turning shaft of the pressing mechanism is likely to be located above the rear end Sa of the sheets S, which are housed in the standby tray 41, in the sheet transport direction D. Thus, the pressing portion of the pressing mechanism is likely to be located above a portion on the downstream side of the sheet transport direction D relative to the rear end Sa of the sheets S. For that reason, in the pressing portion of the pressing mechanism, it is difficult to press a portion close to the rear edge Se of the rear end Sa of the sheets S.

Here, as shown in FIG. 8, the rear end Sa of the sheets S may have an upward curl Ca. For example, the rear end Sa of the sheets S may have a relatively large curl Ca. In the case where the sheets S have such a curl Ca, in the pressing mechanism of the comparative example described above, it is difficult to press a portion close to the rear edge Se of the sheets S. Thus, it is difficult to appropriately press the curl Ca. When the rear end Sa of the sheets S is hit by the paddle unit 34 in a state where the curl Ca is hard to press appropriately, the paddle unit 34 comes into contact with the sheets S at a relatively higher position than the case where the sheets S do not have the curl Ca. When the paddle unit 34 comes into contact with the sheets S at a relatively higher position, a contact direction of the paddle unit 34 with respect to the sheets S is likely to be oriented in the opposite direction to the stapler 62. Thus, in the case where the sheets S have the curl Ca, the paddle unit 34 may push out the sheets S in the opposite direction to the stapler 62. When the sheets S are pushed out in the opposite direction to the stapler 62, the movement of the sheets S becomes unstable. Additionally, the time necessary to transport the sheets S, which have dropped on the processing tray 61, to the stapler 62 is increased.

Further, the post-processing apparatus 3 is demanded to achieve high-speed processing. Here, if a drop between the sheet discharge port 31*d* of the transport path 31 and the standby tray 41 is large, a certain period of time is necessary in order to move the sheets S from the transport path 31 to the standby tray 41. Further, if a drop between the sheet discharge port 31*d* of the transport path 31 and the standby tray 41 is large, the curl Ca of the sheets S housed in the standby tray 41 may become large. If the curl Ca of the sheets S becomes large, the transport of subsequent sheets S may be inhibited.

In this regard, in the post-processing apparatus 3 of this embodiment, in order to reduce a drop between the sheet discharge port 31*d* of the transport path 31 and the standby tray 41, the standby tray 41 is disposed to be slightly lower than the sheet discharge port 31*d*. According to such a configuration, it is possible to shorten the time to move the sheets S from the transport path 31 to the standby tray 41. As a result, it is possible to achieve speed-up of the post-processing apparatus 3. Further, according to the configuration described above, a gap between the standby tray 41 and the transport guide 43 is relatively reduced. Thus, it is possible to prevent the curl Ca of the sheets S housed in the standby tray 41 from becoming large.

However, according to the configuration described above, the standby tray 41 is disposed at a relatively higher position than the paddle unit 34. So, in the case where the sheets S have the curl Ca, the paddle unit 34 may come into contact with the sheets S at a relatively higher position. In other words, the sheets S are highly likely to be pushed out in the opposite direction to the stapler 62.

In this regard, the post-processing apparatus 3 of this embodiment includes the standby tray 41, the processing tray 61, and the transport guide 43. The processing tray 61 is provided below the standby tray 41. The transport guide 43 includes the turning shaft 81. The turning shaft 81 is located on the downstream side of the sheet transport direction D relative to the rear end Sa of the sheets S housed in the standby tray 41. In the case where the sheets S are moved from the standby tray 41 toward the processing tray 61, the transport guide 43 rotates about the turning shaft 81, and thus presses the sheets S toward the processing tray 61 at a position on the upstream side relative to the turning shaft 81.

According to such a configuration, the pressing portion 82 of the transport guide 43 can be disposed above the rear end Sa of the sheets S. Thus, it is possible to press the rear end Sa of the sheets S by the pressing portion 82 of the transport guide 43. Thus, even in the case where the sheets S have a relatively large curl Ca, the pressing portion 82 of the transport guide 43 can appropriately press the curl Ca of the sheets S. Thus, in the case where the sheets S are moved from the standby tray 41 toward the processing tray 61, a possibility that the paddle unit 34 comes into contact with the sheets S at a relatively higher position can be reduced. In other words, it is possible to prevent the sheets S from being pushed out in the opposite direction to the stapler 62. As a result, the stability of movement of the sheets S can be improved.

In this embodiment, the transport guide 43 is movable between a first position at which the transport guide 43 is located above the standby tray 41 and a second position at which the transport guide 43 protrudes downward below the standby tray 41.

According to such a configuration, the sheets S can be reliably guided to a position lower than the standby tray 41 by the transport guide 43. As a result, a possibility that the paddle unit 34 comes into contact with the sheets S at a relatively higher position can be further reduced. As a result, the stability of movement of the sheets S can be further improved.

In this embodiment, the post-processing apparatus 3 includes the paddle unit 34. The paddle unit 34 is provided below the standby tray 41. In the case where the sheets S are moved from the standby tray 41 toward the processing tray 61, the paddle unit 34 presses the sheets S toward the processing tray 61. The paddle unit 34 rotates in a state where at least a part of the transport guide 43 protrudes downward below the processing tray 61. As a result, the paddle unit 34 presses the sheets S toward the processing tray 61 in a state where at least a part of the transport guide 43 protrudes downward below the processing tray 61.

According to such a configuration, the paddle unit 34 can press the sheets S more downward in a state where the sheets S are pressed by the transport guide 43. In other words, even in the case where the sheets S have the curl Ca, the paddle unit 34 can press the sheets S in a state where the curl Ca is pressed by the transport guide 43. Thus, it is possible to further reduce a possibility that the paddle unit comes into contact with the sheets S at a relatively higher position. As a result, the stability of movement of the sheets S can be further improved.

For example, the paddle unit 34 is driven to press the sheets S at a timing at which the transport guide 43 reaches the lowermost position. However, a timing at which the paddle unit 34 presses the sheets S is not limited to the above example. For example, the paddle unit 34 may hit the sheets S at a timing before the timing at which the transport guide 43 moves to the lowermost position, or at another timing.

In this embodiment, the processing tray 61 includes the sheet placing surface (upper surface 61*a*) on which the sheets S are placed. The paddle unit 34 includes the rotating shaft 49. The transport guide 43 descends to a position aligned with at least a part of the rotating shaft 49 of the paddle unit 34 in a direction substantially parallel to the sheet placing surface.

According to such a configuration, the sheets S can be reliably guided to a position close to the rotating shaft 49 of the paddle unit 34 by the transport guide 43. When the sheets S are guided to a position close to the rotating shaft 49 of the paddle unit 34 by the transport guide 43, the paddle unit 34 can come into contact with the sheets S at a relatively lower position. When the paddle unit 34 comes into contact with the sheets S at a relatively lower position, a contact direction T of the paddle unit 34 with respect to the sheets S is likely to be oriented in a direction substantially orthogonal to the upper surface 61*a* of the processing tray 61 or a direction oriented to the stapler 62. Thus, it is easy to efficiently transport the sheets S, which have dropped on the processing tray 61, toward the stapler 62. If it is easy to efficiently transport the sheets S, which have dropped on the processing tray 61, toward the stapler 62, the speed-up of the post-processing apparatus 3 can be achieved.

However, the transport guide 43 is not limited to one that descends to the position aligned with the rotating shaft of the paddle unit 34 in the direction substantially parallel to the sheet placing surface. For example, the transport guide 43 may descend to a position lower than the base 54 of at least one of the paddles 51 and 52 in the direction substantially parallel to the sheet placing surface. Further, the transport guide 43 may descend to a position lower than an upper end of the rotating body 50 in the direction substantially parallel to the sheet placing surface. In those configurations as well, the sheets S can be guided to a relatively lower position by the transport guide 43. As a result, it is possible to prevent the sheets S from being strongly pressed by the paddle unit 34 toward the opposite direction to the stapler 62.

In this embodiment, the paddle unit 34 includes the paddles 51 and 52 that are provided separately from one another in the sheet width direction W. The transport guide 43 includes the notches 83 at positions corresponding to the paddles 51 and 52. The paddles 51 and 52 can pass through the notches 83.

According to such a configuration, it is possible to provide a transport guide 43 that extends to the upstream side of the sheet transport direction D beyond at least a part of the rotation trajectories (rotation pathways) of the paddles 51 and 52. According to the transport guide 43 as described above, it is possible to press a portion closer to the rear edge Se of the rear end Sa of the sheets S housed in the standby tray 41. If the portion close to the rear edge Se of the rear end Sa of the sheets S can be pressed, even in the case where the sheets S have the curl Ca, a curve of the curl Ca can be further reduced. As a result, a possibility that the paddle unit 34 comes into contact with the sheets S at a relatively higher position can be further reduced. As a result, the stability of movement of the sheets S can be further improved.

From a different perspective, the pressing portion 82 of the transport guide 43 is located near the sheet discharge port 31*d* of the transport path 31. The pressing portion 82 of the transport guide 43 extends to a position that overlaps with at least a part of the rotating shaft 49 of the paddle unit 34 in the vertical direction. According to such a configuration, the pressing portion 82 can press a portion closer to the rear edge Se of the rear end Sa of the sheets S housed in the standby tray 41.

In this embodiment, the transport guide 43 has a length substantially equal to or larger than the half length of the standby tray 41 in the sheet transport direction D. The turning shaft 81 is provided to the front end of the transport guide 43. The pressing portion 82 is provided to the rear end of the transport guide 43. In other words, according to the configuration described above, a distance between the turning shaft 81 and the pressing portion 82 is relatively large. When the distance between the turning shaft and the pressing portion 82 is relatively large, the transport guide 43 moves between the standby position and the protruding position in a relatively gentle arc. When the transport guide 43 moves in a relatively gentle arc, it is possible to prevent the transport guide 43 from causing a strong force oriented in the opposite direction to the stapler 62 to act on the sheets S.

In this embodiment, the transport guide 43 has a length substantially the same as the standby tray 41 in the sheet transport direction D. According to such a configuration, the distance between the turning shaft 81 and the pressing portion 82 is further increased. Thus, according to the configuration described above, it is possible to further prevent the transport guide 43 from causing a strong force oriented in the opposite direction to the stapler 62 to act on the sheets S.

From a different perspective, in this embodiment, the turning shaft 81 of the transport guide 43 is located at substantially the same position as the front end of the standby tray 41 in the sheet transport direction D. Further, the turning shaft 81 of the transport guide 43 is located on the downstream side of the sheet transport direction D relative to the boundary portion 45*bc* of the upper surface 45*b* of the standby tray 41. Further, the turning shaft 81 of the transport guide 43 is located on the downstream side of the sheet transport direction D relative to the drive member 91. According to those configurations, the distance between the turning shaft 81 and the pressing portion 82 is relatively large. Thus, according to those configurations, it is possible to further prevent the transport guide 43 from causing a strong force oriented in the opposite direction to the stapler 62 to act on the sheets S.

The configuration of the sheet processing apparatus is not limited to the examples described above. For example, an example of the sheet processing apparatus may be an image-forming apparatus including an inner finisher within a casing.

According to at least one embodiment described above, the post-processing apparatus 3 includes the standby tray 41, the processing tray 61, and the transport guide 43. The processing tray 61 is provided below the standby tray 41. The transport guide 43 includes the turning shaft 81. The turning shaft 81 is located on the downstream side of the sheet transport direction D relative to the rear end Sa of the sheets S housed in the standby tray 41. In the case where the sheets S are moved from the standby tray 41 toward the processing tray 61, the transport guide 43 rotates about the turning shaft 81, and thus presses the sheets S toward the processing tray 61 at a position on the upstream side relative to the turning shaft 81. As a result, the stability of movement of the sheets S can be improved.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A sheet processing apparatus, comprising:

a first tray that supports a transported sheet;

at least one roller that transports the sheet to the first tray;

a second tray that is provided below the first tray;

a paddle unit located at a position below and upstream of the first tray in a transport direction of the sheet transported to the first tray, the paddle unit including paddles for pressing the sheet toward the second tray to guide the sheet from the first tray to the second tray; and a pressing member that:

includes a turning shaft, the turning shaft being located on a downstream side of the first tray in a transport direction of the sheet transported to the first tray, includes notches on a upstream end of the pressing member in the transport direction of the sheet transported to the first tray, the notches corresponding to the paddles so that the paddle pass through the notches when the paddles press the sheet toward the second tray, and when the sheet is moved from the first tray toward the second tray, rotates about the turning shaft to press the sheet toward the second tray, the pressing member pressing the sheet at a position upstream of the turning shaft in the transport direction of the sheet transported to the first tray.

2. The sheet processing apparatus according to claim 1, wherein the pressing member is movable between a first position at which the pressing member is located above the first tray and a second position at which the pressing member protrudes downward below the first tray.

3. The sheet processing apparatus according to claim 1, wherein the paddle unit rotates so that the paddles press the sheet in a state where at least a part of the pressing member protrudes downward below the first tray.

4. The sheet processing apparatus according to claim 3, wherein the paddle unit rotates to press the sheet at a timing at which the pressing member reaches a lowermost position.

5. The sheet processing apparatus according to claim 3, wherein the second tray includes a sheet placing surface on which the sheet is placed, the paddle unit includes a rotating shaft, a rotating body that rotates about the rotating shaft to press the sheet, the paddles being attached to the rotating body, and the pressing member descends to a position aligned with at least a part of the rotating shaft in a direction substantially parallel to the sheet placing surface.

6. The sheet processing apparatus according to claim 5, wherein the pressing member descends to a position lower, in the direction substantially parallel to the sheet placing surface, than a boundary portion between at least one of the paddles and the rotating body.

7. The sheet processing apparatus according to claim 5, wherein the pressing member descends to a position lower, in the direction substantially parallel to the sheet placing surface, than an upper end of the rotating body.

8. The sheet processing apparatus according to claim 5, further comprising a transport path, the sheet supplied from outside being transported through the transport path to the first tray via a discharge port, wherein a pressing portion of the pressing member that presses the sheet is located near the discharge port of the transport path.

9. The sheet processing apparatus according to claim 8, wherein the pressing portion of the pressing member extends to a position overlapping with at least a part of the rotating shaft of the paddle unit in a vertical direction.

10. The sheet processing apparatus according to claim 8, wherein the pressing member is a transport guide provided above the first tray and presses the transported sheet towards the first tray, the transport guide having a length substantially equal to or larger than a half length of the first tray in the transport direction of the sheet transported to the first tray, the turning shaft is provided on a front end of the transport guide in the transport direction of the sheet transported to the first tray, and the pressing portion is provided on a rear end of the transport guide opposite of the front end.

11. The sheet processing apparatus according to claim 2, wherein the pressing member moves between the first position and the second position in a relatively arc-like trajectory.

12. The sheet processing apparatus according to claim 10, wherein the transport guide has a length substantially equal to a length of the first tray in the transport direction of the sheet transported to the first tray.

13. The sheet processing apparatus according to claim 10, wherein the turning shaft of the pressing member is located at substantially the same position as a front end of the first tray in the transport direction of the sheet transported to the first tray.

14. The sheet processing apparatus according to claim 1, wherein the first tray includes a bottom wall, the bottom wall including a lower surface that is formed in a substantially flat surface, and an upper surface on which the sheet is transported, the upper surface including a first area and a second area, the first area being provided adjacently to a rear end of the first tray and tilted with respect to the lower surface to gradually increase a distance from the lower surface toward the downstream side of the transport direction of the sheet, the second area being provided between a front end of the first tray and the first area and having a fixed distance from the lower surface or a reduced distance from the lower surface even toward the downstream side of the transport direction of the sheet, and the turning shaft of the pressing member is located on the downstream side of the transport direction of the sheet relative to a boundary portion between the first area and the second area.

15. A sheet processing apparatus comprising:

a first tray that supports a transported sheet;

at least one roller that transports the sheet to the first tray;

a second tray that is provided below the first tray, the second tray including a sheet placing surface on which the sheet is placed;

a paddle unit located at a position below and upstream of the first tray in a transport direction of the sheet transported to the first tray, the paddle unit including:

paddles for pressing the sheet toward the second tray to guide the sheet from the first tray to the second tray, a rotating shaft, and rotating body that rotates about the rotating shaft to press the sheet, the paddles being attached to the rotating body; and a pressing member that:

includes a turning shaft, the turning shaft being located on a downstream side of the first tray in a transport direction of the sheet transported to the first tray, includes notches on a upstream end of the pressing member in the transport direction of the sheet transported to the first tray, the notches corresponding to the paddles so that the paddle pass through the notches when the paddles press the sheet toward the second tray, and when the sheet is moved from the first tray toward the second tray, rotates about the turning shaft to press the sheet toward the second tray, the pressing member pressing the sheet at a position upstream of the turning shaft in the transport direction of the sheet transported to the first tray, wherein:

the paddles of the paddle unit are attached to the rotating body separately from one another in a sheet width direction that is substantially orthogonal to the transport direction of the sheet transported to the first tray, the pressing member descends to a position aligned with at least a part of the rotating shaft in a direction substantially parallel to the sheet placing surface, and the paddle unit rotates so that the paddles press the sheet in a state where at least a part of the pressing member protrudes downward below the first tray.

* * * * *